US011732543B2

(12) United States Patent
Arteaga

(10) Patent No.: US 11,732,543 B2
(45) **Date of Patent: *Aug. 22, 2023**

(54) ROTATING CONTROL DEVICE SYSTEMS AND METHODS

(71) Applicant: Cameron International Corporation, Houston, TX (US)

(72) Inventor: Nicolas Arteaga, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 38 days.

This patent is subject to a terminal disclaimer.

(21) Appl. No.: 17/002,479

(22) Filed: Aug. 25, 2020

(65) Prior Publication Data

US 2022/0065066 A1 Mar. 3, 2022

(51) Int. Cl.
*E21B 33/06* (2006.01)
*E21B 33/08* (2006.01)

(52) U.S. Cl.
CPC ..... *E21B 33/085* (2013.01); *E21B 33/063* (2013.01)

(58) Field of Classification Search
CPC ..... E21B 33/02; E21B 33/03; E21B 33/085; E21B 33/062; E21B 33/063
USPC ..... 251/1.1, 1.2, 1.3
See application file for complete search history.

(56) References Cited

U.S. PATENT DOCUMENTS 2,170,916 A * 8/1939 Schweitzer ..... E21B 33/085 175/84
2,207,149 A 7/1940 Hild
2,760,749 A * 8/1956 Ratigan ..... E21B 33/062 251/1.3
2,929,610 A * 3/1960 Stratton ..... E21B 33/035 166/381
3,023,012 A * 2/1962 Wilde ..... E21B 33/085 166/368

(Continued)

FOREIGN PATENT DOCUMENTS

EP 0261629 A2 3/1988
EP 3540176 A1 9/2019

(Continued)

OTHER PUBLICATIONS

International Search Report and Written Opinion issued in International Patent application PCT/US2021/047144 dated Nov. 29, 2021, 13 pages.

*Primary Examiner* — Kevin F Murphy
*Assistant Examiner* — Jonathan J Waddy
(74) *Attorney, Agent, or Firm* — Kelly McKinney

(57) ABSTRACT

A pressure control system includes a housing having a bore and a first pair of opposed rams positioned within the housing. The first pair of opposed rams is configured to move between a retracted position and an extended position relative to the bore. The pressure control system further includes a rotating control device (RCD) seal assembly, which includes a frame that is configured to couple to the first pair of opposed rams while the first pair of opposed rams are in the extended position relative to the bore, an annular seal element coupled to the frame, and a bearing assembly positioned between the annular seal element and the frame. The annular seal element is configured to seal about a tubular within the bore, and the bearing assembly is configured to enable the annular seal element to rotate relative to the frame and the first pair of opposed rams.

12 Claims, 5 Drawing Sheets

(56) References Cited

U.S. PATENT DOCUMENTS 3,915,426 A * 10/1975 LeRouax ..... E21B 33/062 251/1.2
4,488,703 A * 12/1984 Jones ..... E21B 33/062 251/1.3
6,102,673 A * 8/2000 Mott ..... F04B 19/003 251/324
6,230,824 B1 * 5/2001 Peterman ..... E21B 33/085 166/359
6,352,129 B1 3/2002 Best
6,575,244 B2 6/2003 Chang et al.
6,904,981 B2 6/2005 van Riet
7,004,448 B2 2/2006 Suter et al.
7,165,610 B2 * 1/2007 Hopper ..... E21B 33/085 166/84.1
7,185,719 B2 3/2007 van Riet
7,350,597 B2 4/2008 Reitsma et al.
7,478,672 B2 1/2009 Rogers et al.
7,487,837 B2 2/2009 Bailey et al.
7,828,081 B2 11/2010 Reitsma
7,866,399 B2 1/2011 Kozicz et al.
3,096,711 A1 1/2012 Beauchamp et al.
8,286,734 B2 10/2012 Hannegan et al.
8,413,724 B2 4/2013 Carbaugh et al.
8,567,525 B2 10/2013 Reitsma
8,573,294 B2 11/2013 Struthers et al.
8,596,345 B2 12/2013 Li et al.
8,631,874 B2 1/2014 Kozicz et al.
8,726,983 B2 5/2014 Khan
8,757,272 B2 6/2014 Couturier et al.
8,820,747 B2 9/2014 Zubia et al.
8,844,633 B2 9/2014 Reitsma et al.
9,038,729 B2 5/2015 Leduc et al.
9,109,405 B2 8/2015 Carbaugh et al.
9,109,420 B2 8/2015 Tindle et al.
9,151,135 B2 10/2015 Eriksen
9,228,433 B2 1/2016 Sawyer et al.
9,284,811 B2 3/2016 Michaud et al.
9,328,574 B2 5/2016 Sehsah
9,341,037 B2 5/2016 Suter
9,388,650 B2 7/2016 Leuchtenberg
9,429,007 B2 8/2016 Reitsma et al.
11,156,054 B2 * 10/2021 Alsup ..... E21B 33/06
11,274,517 B2 3/2022 Tenorio et al.
2001/0050168 A1 * 12/2001 Hult ..... E21B 19/00 166/84.1
2004/0113108 A1 6/2004 Ward
2009/0057024 A1 3/2009 Williams
2009/0101411 A1 * 4/2009 Hannegan ..... E21B 21/08 175/48
2009/0200747 A1 * 8/2009 Williams ..... E21B 47/12 277/344
2010/0252328 A1 10/2010 Williams et al.
2012/0013133 A1 * 1/2012 Rios, III ..... E21B 33/038 292/159
2012/0241163 A1 9/2012 Reitsma et al.
2014/0048331 A1 2/2014 Boutalbi et al.
2014/0209316 A1 7/2014 Tindle et al.
2014/0216751 A1 8/2014 Liezenberg
2014/0262313 A1 9/2014 Gilmore et al.
2015/0034384 A1 2/2015 Leuchtenberg
2015/0275610 A1 * 10/2015 Tan ..... E21B 33/04 166/85.4
2016/0186522 A1 * 6/2016 Peer ..... E21B 41/0085 166/65.1
2017/0159381 A1 6/2017 Orban
2018/0087571 A1 * 3/2018 Liezenberg ..... F16C 19/52
2018/0156029 A1 * 6/2018 Harrison ..... E21B 47/092
2018/0355683 A1 * 12/2018 Eriksen ..... E21B 33/085
2019/0093445 A1 * 3/2019 Kulkarni ..... E21B 47/10
2019/0100988 A1 4/2019 Ellis
2020/0087998 A1 * 3/2020 Bushman ..... E21B 44/00
2021/0372222 A1 * 12/2021 Tenorio ..... E21B 33/085

FOREIGN PATENT DOCUMENTS

GB 2135717 A 9/1984
WO 2007047800 A2 4/2007
WO 2010082831 A1 7/2010
WO 2012035001 A2 3/2012
WO 2014087371 A1 6/2014
WO 2017039740 A1 3/2017

* cited by examiner

ROTATING CONTROL DEVICE SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources have a profound effect on modern economies and societies. In order to meet the demand for such natural resources, numerous companies invest significant amounts of time and money in searching for, accessing, and extracting natural resources. Particularly, once a desired natural resource is discovered below the surface of the earth, drilling systems are often employed to access the desired natural resource. These drilling systems can be located onshore or offshore depending on the location of the desired natural resource. Such drilling systems may include a drilling fluid system configured to circulate drilling fluid into and out of a wellbore to facilitate drilling the wellbore.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
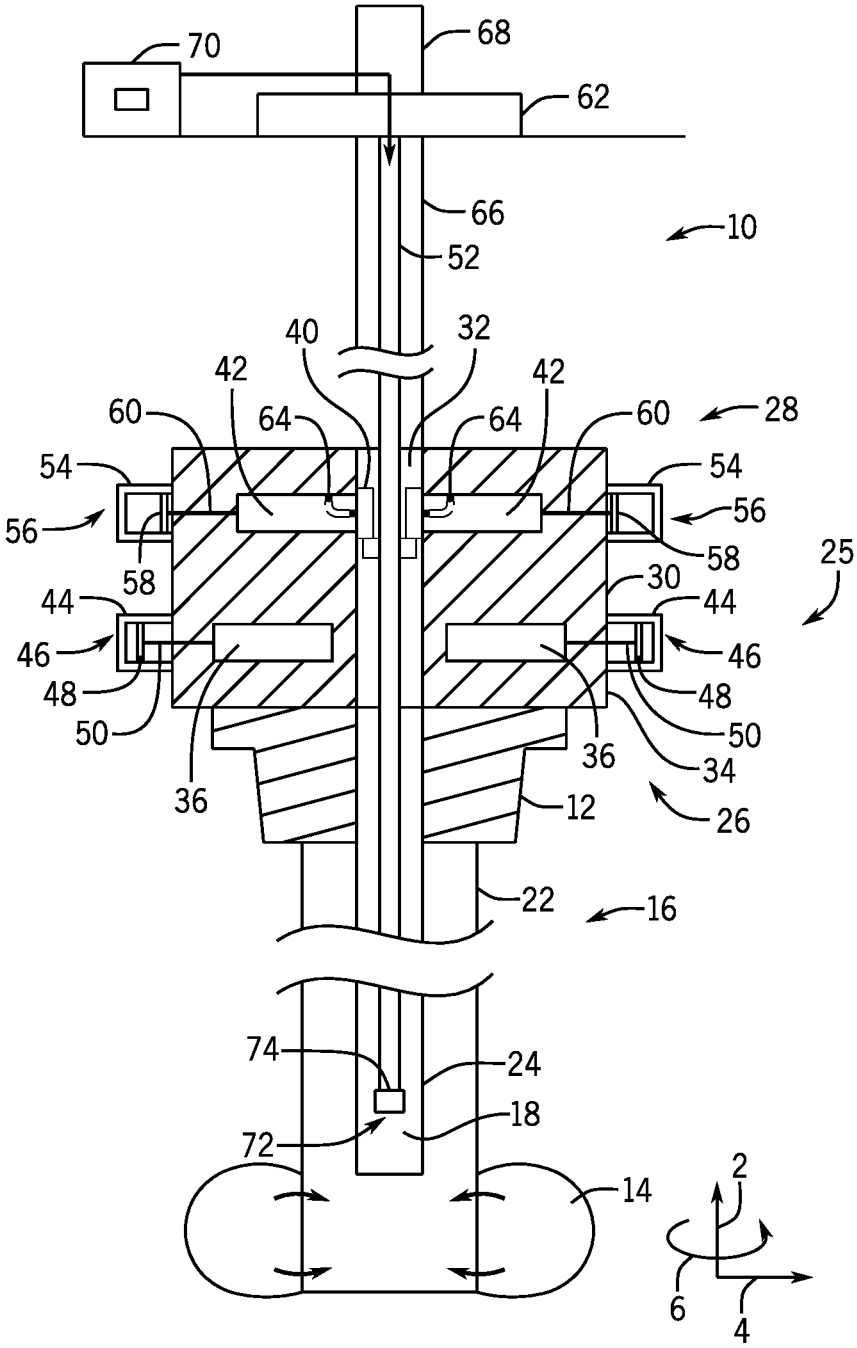
FIG. 1 is a schematic diagram of a drilling system having a pressure control system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" may be used to distinguish components to facilitate discussion, and it should be noted that the numerical terms may be used differently or assigned to different elements in the claims. The drawing figures are not necessarily to scale. Certain features and components herein may be shown exaggerated in scale and/or in somewhat schematic form. Some details may not be shown in the interest of clarity and conciseness.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., expand the well) and/or blocks the well from collapsing under its own weight. The ability to manage the pressure and the flow of the drilling fluid enables use of the drilling system to drill in various locations, such as locations with relatively softer sea beds.

The drilling system of the present disclosure may include a pressure control system. The pressure control system may include a housing that defines a bore, and the drill string may extend through the bore during drilling operations. A rotating control device (RCD) system may be positioned within the housing, and the RCD system may include an RCD seal assembly that includes a seal element that is configured to seal against the drill string to thereby block a fluid flow (e.g., the drilling fluid, cuttings, and/or natural resources [e.g., carbon dioxide, hydrogen sulfide]) within the annular space from passing across the seal element (e.g., from the well toward the platform). While the seal element is sealed against the drill string, the fluid flow may be diverted from the annular space toward a suitable location (e.g., a collection tank). As discussed in more detail below, the RCD seal assembly may be supported on rams (e.g., opposed rams) that are configured to hold the RCD seal assembly within the housing.

With the foregoing in mind, FIG. 1 is a schematic diagram that illustrates an embodiment of a drilling system 10 that is configured to carry out drilling operations. The drilling system 10 may be a subsea system or a land-based (e.g., surface) system. The drilling system 10 may use MPD techniques. The drilling system 10 and its components may be described with reference to a vertical axis 2 (or vertical direction), a longitudinal axis 4 (or longitudinal direction), and a circumferential axis 6 (or direction) to facilitate discussion.

As illustrated, the drilling system 10 includes a wellhead assembly 12 coupled to a mineral deposit 14 via a well 16 having a wellbore 18. The wellhead assembly 12 may include or be coupled to multiple components that control and regulate activities and conditions associated with the well 16. For example, the wellhead assembly 12 may include or be coupled to pipes, bodies, valves, and seals that enable drilling of the well 16, route produced minerals from the mineral deposit 14, provide for regulating pressure in the well 16, and/or provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead assembly 12 may include a tubing spool, a casing spool, and a hanger to enable installation of the casing 24.

As shown, the wellhead assembly 12 may be coupled to a pressure control system 25 (e.g., pressure control stack), which may include a blowout preventer (BOP) system 26 (e.g., BOP portion) and/or a rotating control device (RCD) system 28 (e.g., RCD portion). The pressure control system 25 may include a housing 30 that defines a bore 32 through the pressure control system 25, and the bore 32 may be in fluid communication with the wellbore 18. The BOP system 26 may include one or more ram BOPs 34 each having opposed rams 36 (e.g., shear rams; pipe rams; BOP rams). Additionally, the RCD system 28 may include an RCD seal assembly 40 (e.g., annular assembly) that is supported on opposed rams 42 (e.g., RCD rams).

In the illustrated embodiment, the BOP system 26 includes bonnet assemblies 44 (e.g., BOP bonnet assemblies) mounted on the housing 30 (e.g., via threaded fasteners). Each bonnet assembly 44 supports an actuator 46 (e.g., BOP actuator), which may include a piston 48 and a connecting rod 50 that is coupled to a respective ram of the opposing rams 36. The actuators 46 drive the opposed rams 36 toward and away from one another along the longitudinal axis 4 to move between a retracted position (e.g., open configuration; unsealed configuration) and an extended position (e.g., closed configuration; sealed configuration). In the retracted position, the opposed rams 36 enable fluid flow across the opposed rams (e.g., in an annular space between a wall of the housing 30 and a tubular 52 within the bore 32 of the housing 30). In the extended position, the opposed rams 36 block the fluid flow across the opposed rams 36. Furthermore, in the retracted position, the opposed rams 36 are withdrawn from the bore 32, do not contact the tubular 52 within the bore 32, and/or do not contact one another. Additionally, in the extended position, the opposed rams 36 are positioned within the bore 32, contact and/or shear the tubular 52 to seal the bore 32, and/or contact one another to seal the bore 32.

In the illustrated embodiment, the RCD system 28 includes bonnet assemblies 54 (e.g., RCD bonnet assemblies) mounted on the housing 30 (e.g., via threaded fasteners). Each bonnet assembly 54 supports an actuator 56 (e.g., RCD actuator), which may include a piston 58 and a connecting rod 60 that is coupled to a respective ram of the opposed rams 42. The actuators 56 drive the opposed rams 42 toward and away from one another along the longitudinal axis 4 to move between a retracted position (e.g., open configuration; unsealed configuration) and an extended position (e.g., closed configuration; sealed configuration). In the retracted position, the opposed rams 42 are withdrawn from the bore 32, do not engage the RCD seal assembly 40, and/or enable fluid flow across the opposed rams (e.g., in an annular space between the wall of the housing 30 and the tubular 52 within the bore 32 of the housing 30). In the extended position, the opposed rams 42 are positioned within the bore 32 and/or engage the RCD seal assembly 40 to hold the RCD seal assembly 40 within the housing 30 and to enable the RCD seal assembly 40 to block the fluid flow across the RCD seal assembly 40. In particular, the RCD seal assembly 40 may seal against the tubular 52 and/or block the fluid flow through the annular space while the tubular 52 moves within the bore 32. For example, the RCD seal assembly 40 may be configured to block the drilling fluid, cuttings, and/or other substances from the well 16 from passing across a seal element of the RCD seal assembly 40 toward a platform 62 while the tubular 52 moves within the bore 32. In some embodiments, the opposed rams 42 include and/or support one or more seal elements, such as the one or more seal elements 64, that assist the RCD seal assembly 40 with sealing the bore 32. For example, the one or more seal elements 64 may extend along laterally-outer walls (e.g., in the longitudinal direction 4) of each of the opposed rams 42 and laterally across an upper surface of each of the opposed rams 42 to seal against the housing 30. The one or more seal elements 64 may also extend laterally across leading edges of the opposed rams 42 to seal against each other when the opposed rams 42 are in the extended position and/or to seal against the RCD seal assembly 40 when coupled to the RCD seal assembly 40. Thus, together the RCD seal assembly 40 and the one or more seal elements, including the one or more seal elements 64, of the opposed rams 42 may seal the bore 32.

As shown, both the BOP system 26 and the RCD system 28 are positioned within the housing 30. The housing 30 may include one piece (e.g., integral) that is configured to house both the opposed rams 36 of the BOP system 26 and the opposed rams 42 of the RCD system 28. Alternatively, the housing 30 may include multiple pieces with at least one piece formed to house the opposed rams 36 of the BOP system 26 and at least one piece formed to house the opposed rams 42 of the RCD system 28. In some such cases, the multiple pieces may be fastened to one another (e.g., via one or more threaded fasteners, such as bolts) to form the housing 30. Regardless of the configuration of the housing 30, the RCD system 28 may be positioned at any suitable location within the drilling system 10, such as any suitable location between the wellbore 18 and the platform 62. For example, the RCD system 28 may be positioned between the BOP system 26 and the platform 62 along the vertical axis 2. Additionally, while the BOP system 26 includes one ram BOP 34 to facilitate discussion, it should be appreciated that the BOP system 26 may include any number of ram BOPs 34 (e.g., one, two, three, four, or more). In such cases, the ram BOPs 34 may be stacked along the vertical axis 2 and may be within the housing 30. The ram BOPs 34 may also be any of a variety of BOP types with pipe rams, shear rams, or the like. All of the ram BOPs 34 may be located below the RCD system 28, such that the RCD system 28 is positioned between all of the ram BOPs 34 and the platform 62.

Alternatively, at least one the BOPs may be located above the RCD system 28, such as between the RCD system 28 and the platform 62.

While the BOP system 26 and the RCD system 28 are described herein as separate systems to facilitate discussion, it should be appreciated that the opposed rams 36 of the BOP system 26 and the opposed rams 42 of the RCD system 28 may be interchangeable with one another. For example, the actuator 46 of the BOP system 26 and the actuator 56 of the RCD system 28 may be similar to or identical to one another. The opposed rams 36 may be coupled to the actuator 46 during a respective first time period, and then the opposed rams 42 may be coupled to the actuator 46 during a respective second time period (e.g., to switch between a BOP system and an RCD system; to convert the BOP system to the RCD system; to use the actuator 46 with different rams and for different functions). Similarly, the opposed rams 36 may be coupled to the actuator 56 during a respective first time period, and then the opposed rams 42 may be coupled to the actuator 56 during a respective second time period (e.g., to switch between a BOP system and an RCD system; to convert the BOP system to the RCD system; to use the actuator 46 with different rams and for different functions). Thus, it should be appreciated that the opposed rams 42 may be temporarily installed onto and/or retrofitted onto an actuator (e.g., the actuator 46 and/or the actuator 56) of a BOP (e.g., of a BOP stack) to thereby use the BOP for RCD operations in the manner disclosed herein.

As shown, a drilling riser 66 may extend between the housing 30 and the platform 62. The platform 62 may include various components that facilitate operation of the drilling system 10, such as pumps, tanks, and power equipment. The platform 62 may also include a derrick 68 that supports the tubular 52 (e.g., drill string), which may extend through the drilling riser 66. A drilling fluid system 70 may direct the drilling fluid into the tubular 52, and the drilling fluid may exit through one or more openings at a distal end portion 72 of the tubular 52 and may return (along with cuttings and/or other substances from the well 16) toward the platform 62 via the annular space (e.g., between the tubular 52 and the casing 24 that lines the wellbore 18; between the tubular 52 and the housing 30; between the tubular 52 and the drilling riser 66). A drill bit 74 may be positioned at the distal end portion 72 of the tubular 52. The tubular 52 may rotate within the drilling riser 66 to rotate the drill bit 74, thereby enabling the drill bit 74 to drill and form the well 16. In operation, the tubular 52 may rotate about and/or move along the vertical axis 2 to enable the drill bit 74 to drill the well 16. As discussed in more detail below, the opposed rams 42 of the RCD system 28 may be configured to hold the RCD seal assembly 40 within the housing 30 to enable the RCD seal assembly 40 to seal against the tubular 52 even as the tubular 52 moves within the drilling riser 66.

Figure 2:
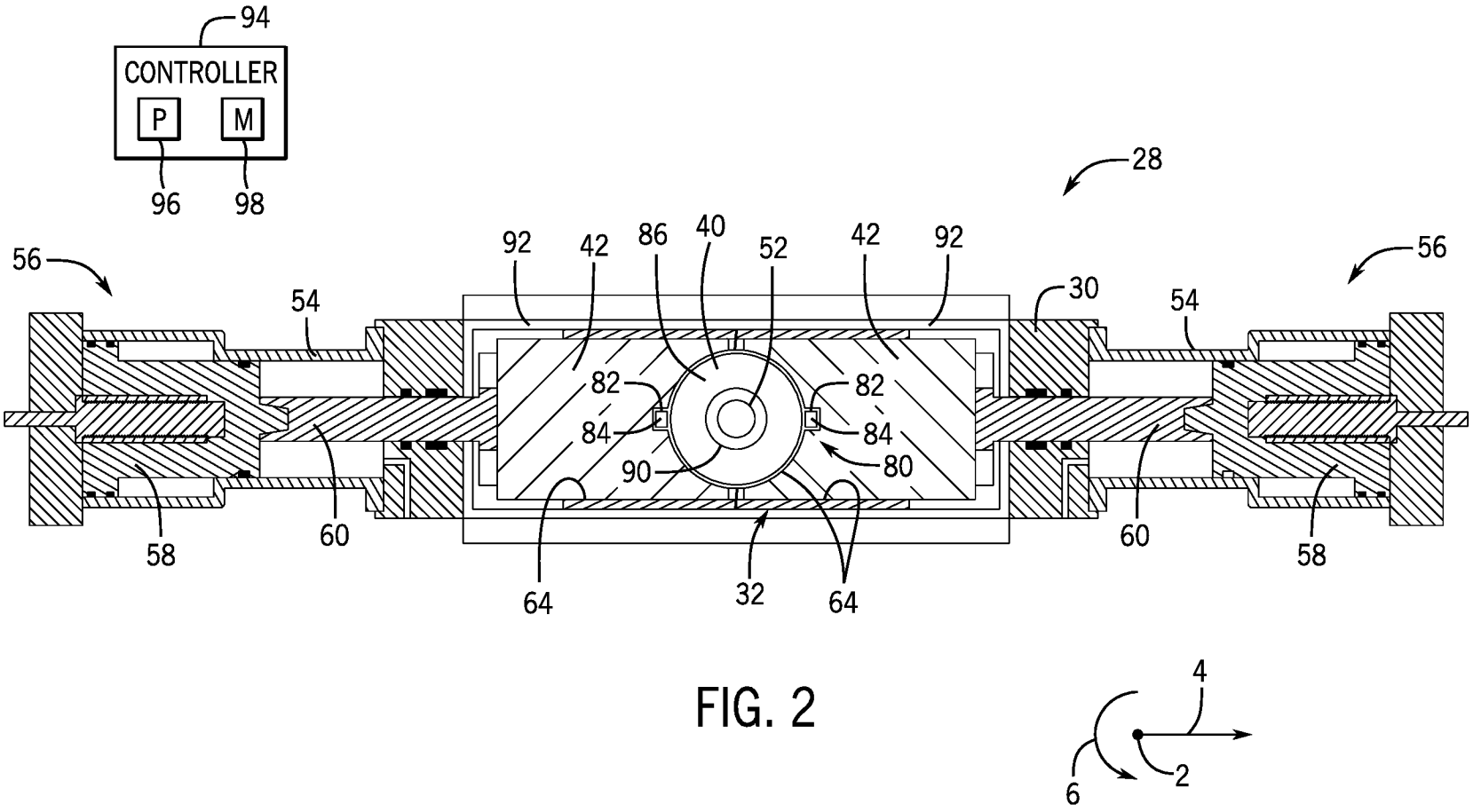
FIG. 2 is a cross-sectional top view of a rotating control device (RCD) system that may be used in the pressure control system of FIG. 1, in accordance with an embodiment of the present disclosure.

FIG. 2 is a cross-sectional top view of an embodiment of the RCD system 28. As shown, the RCD system 28 includes the RCD seal assembly 40 that is supported by and coupled to the opposed rams 42 while the opposed rams 42 are in the extended position. In particular, the RCD seal assembly 40 is supported by and coupled to the opposed rams 42 via an interface 80 (e.g., one or more key-slot interfaces; one or more stab connections). As an example, the interface 80 may include first and second retaining features, such as a respective recess 82 formed in each opposed ram 42 and multiple protrusions 84 extending radially-outwardly from a frame 86 (e.g., body; rigid frame) of the RCD seal assembly 40. However, it should be appreciated that the interface 80 may additionally or alternatively include one or more recesses formed in the frame 86 of the RCD seal assembly 40 and one or more protrusions formed in each opposed ram 42. Additionally, the interface 80 may include multiple recesses and protrusions (e.g., spaced apart along the circumferential axis 6). Regardless of the configuration of the interface 80, the opposed rams 42 may hold the RCD seal assembly 40 within the housing 30 and may enable the RCD seal assembly 40 to block the fluid flow within the annular space between the tubular 52 and the housing 30. In FIG. 2, the RCD seal assembly 40 and the opposed rams 42 are in an engaged configuration, and the opposed rams 42 circumferentially surround the RCD seal assembly 40.

As shown, the RCD seal assembly 40 may include a seal element 90 (e.g., annular seal element; elastomer) that is configured to contact and seal about the tubular 52 as the tubular 52 moves within the bore 32. As shown, the housing 30 also defines cavities 92 that support the opposed rams 42. A central axis of the bore 32 extends along the vertical axis 2, while a central axis of the cavities 92 extends along the longitudinal axis 4 and is transverse (e.g., orthogonal) to the central axis of the bore 32. Thus, as the opposed rams 42 move (e.g. slide) within the cavities 92, the opposed rams 42 move along the longitudinal axis 4 into and out of the bore 32.

The opposed rams 42 include one or more seal elements 64, which are configured to seal against the cavities 92 to assist the seal element 90 in sealing the bore 32. As shown, the one or more seal elements 64 may extend along laterally-outer walls (e.g., in the longitudinal direction 4) of each of the opposed rams 42 to seal against the housing 30 and may also extend laterally across leading edges of the opposed rams 42 to seal against each other when the opposed rams 42 are in the extended position and/or to seal against the RCD seal assembly 40 when coupled to the RCD seal assembly 40. As shown in FIG. 1, the one or more seal elements 64 may also extend laterally across an upper surface of each of the opposed rams 42 to seal against the housing 30. Thus, together the RCD seal assembly 40 and the one or more seal elements, including the one or more seal elements 64, of the opposed rams 42 may seal the bore 32.

As shown, the RCD system 28 includes the bonnet assemblies 54 mounted on the housing 30 (e.g., via threaded fasteners). Each bonnet assembly 54 supports one actuator 56, which may include the piston 58 and the connecting rod 60 that is coupled to a respective ram of the opposed rams 42. The actuators 56 drive the opposed rams 42 toward and away from one another along the longitudinal axis 4 to move between the retracted position and the extended position. As discussed in more detail below, a controller 94 (e.g., electronic controller) may control the actuators 56 to move the opposed rams 42 in a manner that enables the opposed rams 42 to engage with the RCD seal assembly 40. For example, during installation of the RCD seal assembly 40, the RCD seal assembly 40 may be lowered into the bore 32 using a tool (e.g., running tool). Then, the controller 94 may control the actuators 56 to move the opposed rams 42 to the extended position in response to the RCD seal assembly 40 being aligned with the opposed rams 42 (e.g., along the vertical axis 2).

The controller 94 includes a processor 96 and a memory device 98. The processor 96 may include one or more processors configured to execute software, such as software for processing signals and/or controlling the components of the RCD system 28. The memory device 98 disclosed herein may include one or more memory devices (e.g., a volatile memory, such as random access memory [RAM], and/or a nonvolatile memory, such as read-only memory [ROM])

that may store a variety of information and may be used for various purposes. For example, the memory device 98 may store processor-executable instructions (e.g., firmware or software) for the processor 96 to execute, such as instructions for processing signals and/or controlling the components of the RCD system 28. It should be appreciated that the controller 94 may include various other components, such as a communication device that is capable of receiving data (e.g., inputs) and/or communicating data to various other devices (e.g., a remote computing system). The controller 94 may also include a display, which may be configured to display data for visualization by an operator. The display may be a touchscreen that is capable of receiving inputs from the operator. However, it should be appreciated that the controller 94 may be configured to receive inputs from the operator via other inputs devices (e.g., push buttons). Indeed, the controller 94 may include or be communicatively coupled to any of a variety of input and/or output devices (e.g., lights, speakers, push buttons, the display) to receive data from and/or to provide data to the operator.

Figure 3:
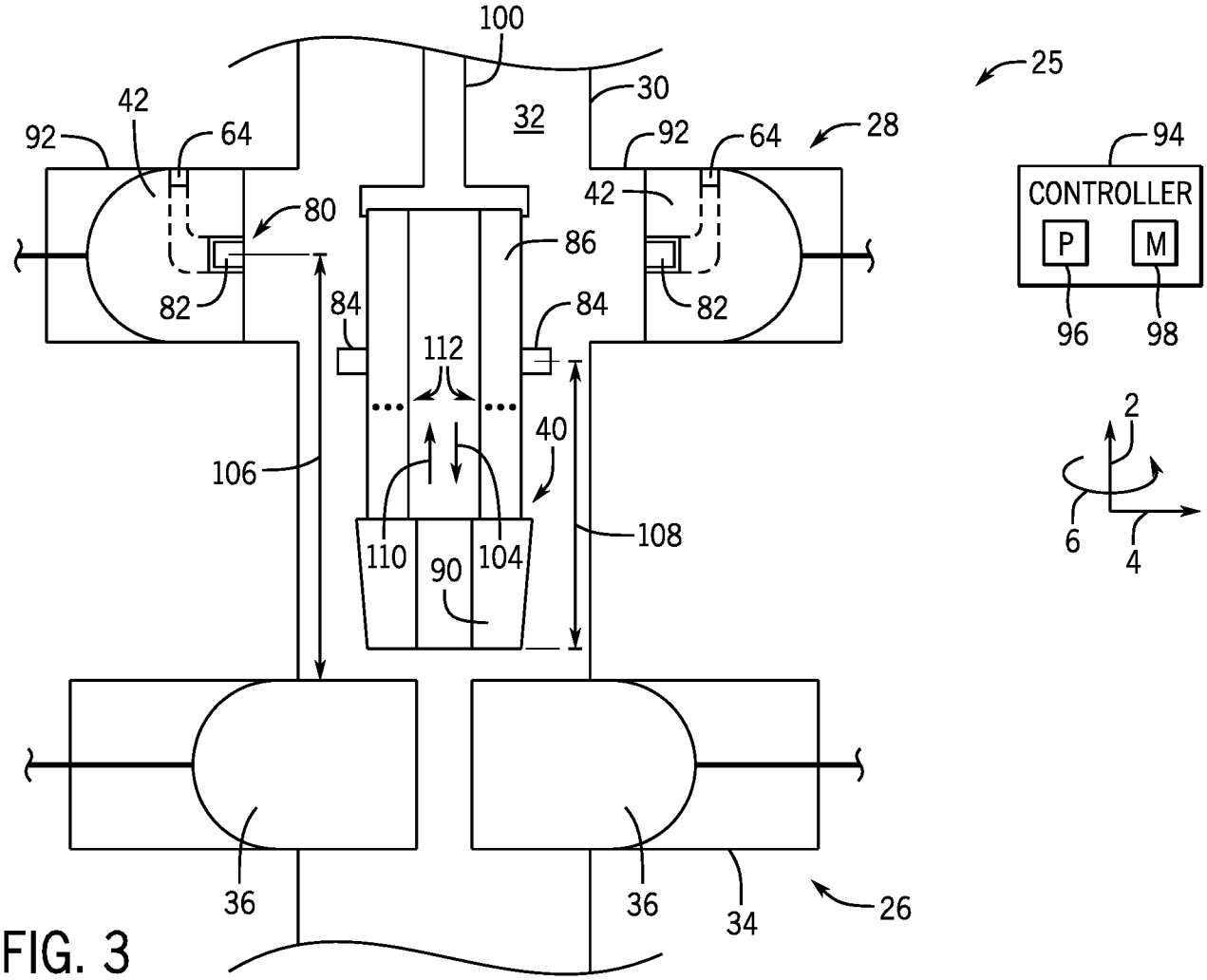
FIG. 3 is a cross-sectional side view of a portion of the RCD system of FIG. 2, wherein an RCD seal assembly is in a disengaged configuration, in accordance with an embodiment of the present disclosure.
Figure 4:
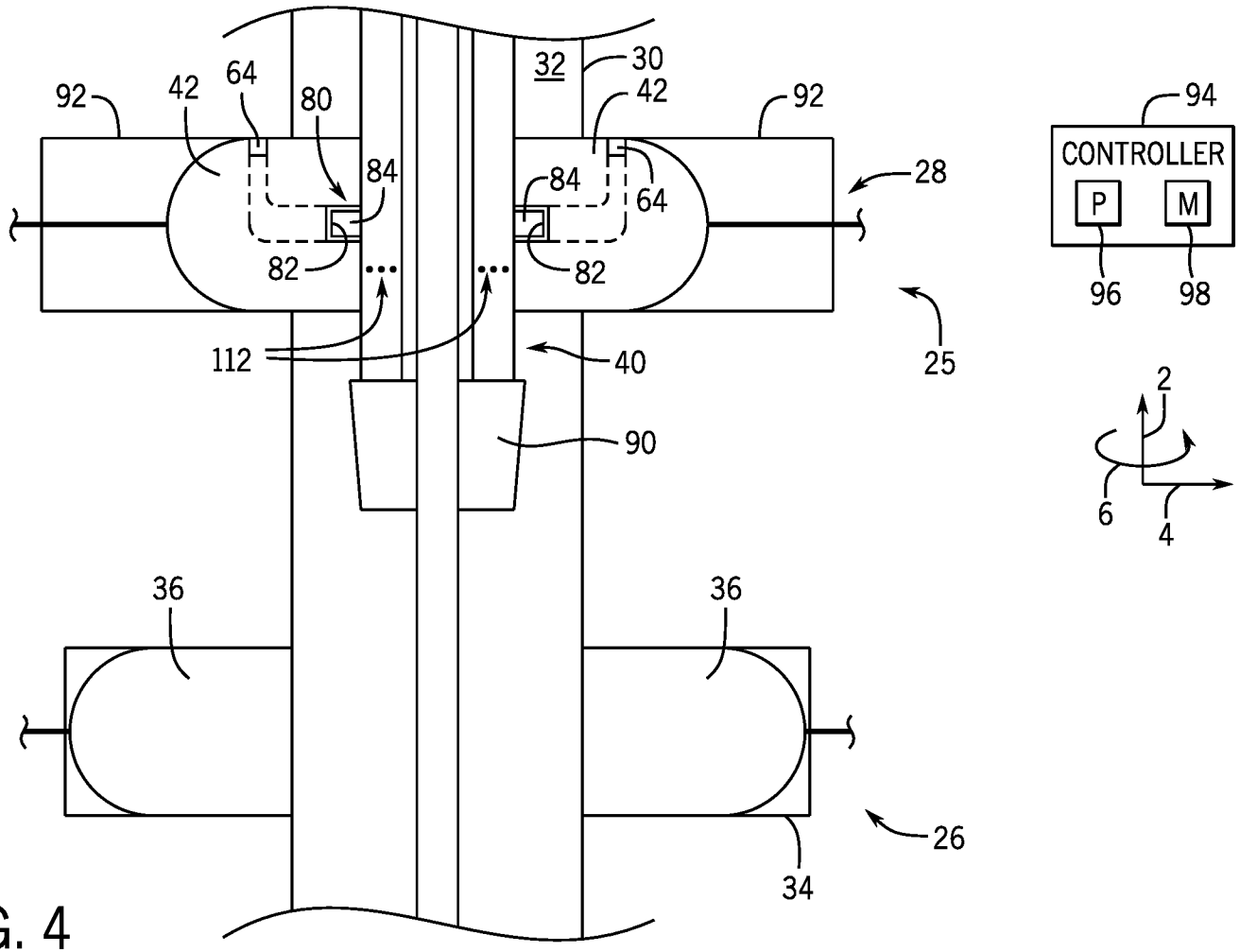
FIG. 4 is a cross-sectional side view of the portion of the RCD system of FIG. 3, wherein the RCD seal assembly is in an engaged configuration, in accordance with an embodiment of the present disclosure.

FIGS. 3 and 4 illustrate an embodiment of a portion the RCD system 28 during an installation process for the RCD seal assembly 40. The installation process for the RCD seal assembly 40 may be carried out at manufacturing or at the wellsite (e.g., while the housing 30 is coupled to and/or positioned above the wellhead at the wellsite). In particular, FIG. 3 is a cross-sectional side view of the portion of the RCD system 28 while the RCD seal assembly 40 is in a disengaged configuration during an initial stage of the installation process. FIG. 4 is a cross-sectional side view of the portion of the RCD system 28 while the RCD seal assembly 40 is in the engaged configuration during a final stage of the installation process.

As shown, during the initial stage of the installation process, the RCD seal assembly 40 may be lowered into the bore 32 of the housing 30 of the pressure control system 25, such as via a tool 100 (e.g., running tool) that is configured to engage the RCD seal assembly 40. For example, the RCD seal assembly 40 may be lowered from the platform, through the drilling riser, and into the bore 32 of the housing 30 of the pressure control system 25. Additionally, during the initial stage of the installation process, the opposed rams 42 of the RCD system 28 may be in the retracted position.

The RCD system 28 may include the controller 94 that is configured to control the position of the RCD seal assembly 40 along the vertical axis 2 (e.g., via control of the tool 100 from the platform) and/or the position of the opposed rams 42 along the longitudinal axis 4 (e.g., via control of the actuators of the RCD system 28) in a coordinated manner to provide for engagement between the RCD seal assembly 40 and the opposed rams 42. For example, the controller 94 may control the tool 100 to lower the RCD seal assembly 40 into the bore 32, and then, the controller 94 may control the actuators to move the opposed rams 42 to the extended position in response to the RCD seal assembly 40 being aligned with the opposed rams 42 (e.g., along the vertical axis 2).

In some embodiments, the opposed rams 36 of one of the ram BOPs 34 of the BOP system 26 (e.g., the ram BOP 34 adjacent to and/or below the RCD system 28) may be utilized to facilitate alignment of the opposed rams 42 and RCD seal assembly 40. The controller 94 may also be configured to control the position of the opposed rams 36 of the ram BOP 34 of the BOP system 26. For example, during the initial stage of the installation process, the controller 94 may control the actuators of the ram BOP 34 to adjust the opposed rams 36 to the extended position, such that the opposed rams 36 are positioned within the bore 32. Then, as shown in FIG. 3, the controller 94 may control the tool 100 to lower the RCD seal assembly 40 through the bore 32 as shown by arrow 104 (e.g., downward toward the well; across the opposed rams 42 along the vertical axis 2) until the RCD seal assembly 40 (e.g., the seal element 90) contacts the opposed rams 36 of the ram BOP 34. The contact between the RCD seal assembly 40 and the opposed rams 36 of the ram BOP 34 may be detected via a sensor, such as a sensor at the platform that detects an increase in resistance to movement of the tool 100, or through any other suitable sensor. The sensor may provide feedback (e.g., data) to the controller 94, which may process the feedback to determine that the RCD seal assembly 40 contacted the opposed rams 36 of the ram BOP 34.

With reference to FIG. 3, a distance 106 along the vertical axis 2 between an upper surface of the opposed rams 36 of the ram BOP 34 and the recesses 82 (or other retaining features) of the opposed rams 42 of the RCD system 28 that are configured to engage with the RCD seal assembly 40 may be known and stored in the memory device 98 of the controller 94. For example, the distance 106 may be measured prior to installation of the housing 30 with the opposed rams 36, 42 at the well. Additionally, a distance 108 along the vertical axis 2 between a lower surface of the RCD seal assembly 40 and the protrusions 84 (or other retaining features) of the RCD seal assembly 40 that are configured to engage with the opposed rams 42 may be known and stored in the memory device 98 of the controller 94. For example, the distance 108 may be measured prior to lowering the RCD seal assembly 40 into the housing 30 at the well.

Then, the controller 94 may control the tool 100 to move the RCD seal assembly 40 in the direction of arrow 110 (e.g., upward, away from the well) based on the distances 106, 108 (e.g., by another distance equal to a difference between the distance 106 and the distance 108; to a target position) to thereby align the RCD seal assembly 40 with the opposed rams 42 along the vertical axis 2. The controller 94 may control the tool 100 to hold the RCD seal assembly 40 at the target position, and the controller 94 may then control the actuators of the RCD system 28 to drive the opposed rams 42 into the bore 32 to engage the RCD seal assembly 40. In this way, the opposed rams 42 of the RCD system 28 may be adjusted from the retracted position to the extended position in response to the RCD seal assembly 40 being aligned with the opposed rams 42 along the vertical axis 2 (e.g., in response to the recesses 82 and the protrusions 84 of the interface 80 being aligned along the vertical axis 2).

As shown in FIGS. 3 and 4, the RCD seal assembly 40 includes the frame 86, the seal element 90, and a bearing assembly 112. The bearing assembly 112 may be provided to enable the seal element 90 to rotate in the circumferential direction 6 with the tubular 52 and relative to the frame 86 and the opposed rams 42. The seal element 90 may be positioned below the frame 86 and below the opposed rams 42 along the vertical axis 2 (e.g., when installed; the seal element 90 may be positioned between the opposed rams 42 and the well along the vertical axis 2). Such placement of the seal element 90 may enable contact between the seal element 90 and the opposed rams 36 during the installation process, which may limit wear or damage to components (e.g., due to elastomer contacting the opposed rams 36). However, other configurations and relative positions are envisioned (e.g., the seal element 90 positioned vertically above the opposed rams 42 along the vertical axis 2). The RCD seal assembly 40 may be separated from the opposed rams 42 (e.g., for maintenance operations). For example, during a removal process, the tool 100 may be inserted into the bore 32 to engage the RCD seal assembly 40. While the tool is engaged with the RCD seal assembly 40, the opposed rams 42 may be moved to the retracted position via the actuators to thereby separate the opposed rams 42 from the RCD seal assembly 40. The tool 100 may then pull the RCD seal assembly 40 along the vertical axis 2 away from the opposed rams 42 (e.g., to the platform for the maintenance operations).

As discussed above, the opposed rams 42 may include one or more seal elements, such as the one or more seal elements 64, that work together with the seal element 90 of the RCD seal assembly 40 to seal the bore 32. The one or more seal elements 64 may be provided at the leading edges of the opposed rams 42, including at the interface 80 to block fluid flow across the interface 80 (e.g., between the recesses 82 and the protrusions 84). Advantageously, the one or more seal elements may seal against the cavities 92 (e.g., vertically-facing walls; upper walls) rather than along the bore 32 (e.g., radially-facing walls; side walls), which may provide a more reliable seal as compared to an arrangement of seal elements that only seals along the bore 32 (e.g., which may be rough or damaged due to exposure to fluid flow or the like).

In some embodiments, the opposed rams 42 may be configured for use only with the RCD seal assembly 40 and/or for RCD operations. However, in some embodiments, the opposed rams 42 may be configured for use with other types of assemblies (e.g., seal assemblies) and/or for BOP operations. For example, the opposed rams 42 may be configured to couple to a BOP seal assembly, such as a pipe ram assembly that is configured to seal about the tubular 52 (e.g., without rotation) and/or a shear ram assembly that is configured to shear the tubular 52. In such cases, the BOP seal assembly may be configured to couple to the opposed rams via the recesses 82 (or other retaining features). Furthermore, in some embodiments, the opposed rams 42 may be configured for use for other operations in the absence of the RCD seal assembly 40. In such cases, while the RCD seal assembly 40 is disengaged from the opposed rams 42, the opposed rams 42 may operate as pipe rams that are configured to seal about the tubular 52 (e.g., without rotation) and/or as shear rams that are configured to shear the tubular 52. Such features may enable efficient transition of the RCD system 28 for use as an RCD device (e.g., having the RCD seal assembly 40 with the seal element 90 that seals about and rotates with the tubular 52) and for use as a BOP (e.g., having a BOP seal element that seals the bore 32 without rotation of the BOP seal element). Such features may also enable the opposed rams 42 to be used for multiple different types of operations, thereby reducing component size and cost. Furthermore, the disclosed embodiments enable placement of the RCD seal assembly 40 within the housing 30 and securement via the opposed rams 42, which may provide a stable and secure structure for the RCD seal assembly 40.

Figure 5:
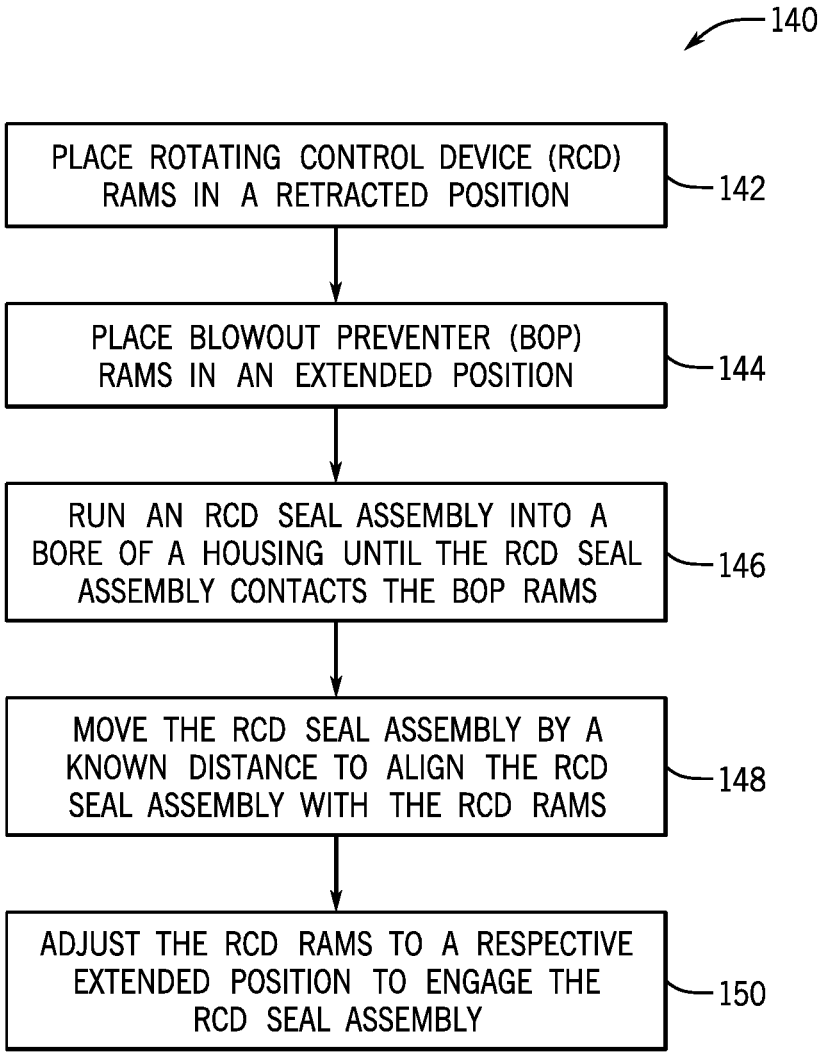
FIG. 5 is a flow diagram of a method of using an RCD system within the drilling system of FIG. 1, in accordance with an embodiment of the present disclosure.

FIG. 5 is a flow diagram of an embodiment of a method 140 of installing and operating an RCD system, such as the RCD system 28 of FIGS. 1-4. The method 140 includes various steps represented by blocks. It should be noted that the method 140 may be performed as an automated procedure by a system, such as the controller 94. Although the flow chart illustrates the steps in a certain sequence, it should be understood that the steps may be performed in any suitable order and certain steps may be carried out simultaneously, where appropriate. Further, certain steps or portions of the method 140 may be performed by separate devices.

In step 142, opposed rams of an RCD system may be adjusted to and/or retained in a retracted position in which the opposed rams of the RCD system are withdrawn from a bore of a housing. In step 144, opposed rams of a BOP system may be adjusted to and/or retained in an extended position in which the opposed rams of the BOP system are positioned in the bore of the housing. In step 146, a tool may be used to run an RCD seal assembly into the bore of the housing (e.g., through the opposed rams of the RCD system) until the RCD assembly contacts the opposed rams of the BOP system. In step 148, the tool may be used to move the RCD seal assembly to align with the opposed rams of the RCD system (e.g., based on a known distance). In step 150, upon completion of the step to move the RCD seal assembly to align with the opposed rams of the RCD system (e.g., in response to the RCD seal assembly being aligned with the opposed rams of the RCD system), the opposed rams may be adjusted from the retracted position to the extended position to engage the RCD seal assembly. Then, the opposed rams may be maintained in the extended position to hold the RCD seal assembly within the bore of the housing to seal about a tubular (e.g., even as the tubular moves within the bore). The RCD seal assembly may be retrieved by using the tool to engage the RCD seal assembly, and then the opposed rams may be adjusted from the extended position to the retracted position to release the RCD seal assembly. Then, the tool may used to lift the RCD seal assembly out of the housing (e.g., to the platform). Thus, the RCD system may provide for a retrievable RCD seal assembly.

It should be appreciated that other techniques for installing and operating the RCD system are envisioned. Furthermore, other techniques for aligning the RCD seal assembly with the opposed rams of the RCD system are envisioned. For example, other structures within the RCD system and/or the BOP system may be utilized to facilitate alignment (e.g., the RCD seal assembly may be lowered until contact with another structure and known distances may be used to subsequently adjust the RCD seal assembly to align with the opposed rams of the RCD system).

Additionally, while the RCD seal assembly is described herein as an annular structure (e.g., continuous ring) that is installed as the annular structure within the housing, it should be appreciated that the RCD seal assembly may include two or more parts that independently couple to a respective one of the opposed rams of the RCD system. Then, when joined together (e.g., end-to-end), the two or more parts form the annular structure that seals against the tubular. In such cases, the two or more parts may each have an arc cross-sectional shape. For example, the two parts may each have a semicircular cross-sectional shape (e.g., 180 degree arc) with a curved central groove (e.g., semicircular groove or cut-out portion) that is configured to receive and to seal about a half of the tubular. Thus, when the opposed rams are driven toward one another with a respective one of the two parts coupled to each of the opposed rams, the respective ends of the two parts contact one another to form the annular seal about the tubular. In some such cases, the opposed rams may move toward and away from one another to adjust a sealing force between the RCD seal assembly and the tubular.

It should be appreciated that all of the features discussed above with respect to FIGS. 1-5 may be combined in any suitable manner. While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A pressure control system, comprising:

a housing comprising a bore, wherein the bore comprises a central axis;

opposed rams positioned in the housing, wherein the opposed rams are configured to move along a longitudinal axis between a retracted position and an extended position relative to the bore, and the longitudinal axis is orthogonal to the central axis; and a rotating control device (RCD) seal assembly that is configured to couple to the opposed rams, wherein the RCD seal assembly comprises:

an annular seal element that is configured to seal about a tubular within the bore; and a bearing assembly that is configured to enable the annular seal element to rotate relative to the opposed rams while the RCD seal assembly is coupled to the opposed rams, wherein the opposed rams are configured to circumferentially surround the RCD seal assembly while the RCD seal assembly is coupled to the opposed rams, and wherein the RCD seal assembly is configured to couple to the opposed rams via a key-slot interface.

2. The pressure control system of claim 1, wherein the opposed rams comprise one or more seal elements that are configured to seal against the housing, such that together the annular seal element and the one or more seal elements are configured to seal the bore.

3. The pressure control system of claim 1, comprising a controller, wherein the controller is configured to drive the opposed rams from the retracted position to the extended position in response to alignment between the opposed rams and the RCD seal assembly along a vertical axis to thereby couple the opposed rams and the RCD seal assembly to one another.

4. A pressure control system, comprising:

a housing comprising a bore;

a first pair of opposed rams positioned within the housing, wherein the first pair of opposed rams is configured to move between a retracted position and an extended position relative to the bore; and a rotating control device (RCD) seal assembly comprising:

a frame that is configured to couple to the first pair of opposed rams while the first pair of opposed rams is in the extended position relative to the bore;

an annular seal element coupled to the frame, wherein the annular seal element is configured to seal about a tubular within the bore; and a bearing assembly positioned between the annular seal element and the frame, wherein the bearing assembly is configured to enable the annular seal element to rotate relative to the frame and the first pair of opposed rams, wherein the first pair of opposed rams comprises one or more seal elements that are configured to seal against the housing, such that together the annular seal element and the one or more seal elements are configured to seal the bore, wherein the first pair of opposed rams is configured to circumferentially surround the RCD seal assembly while the RCD seal assembly is coupled to the first pair of opposed rams, and wherein the frame is configured to couple to the first pair of opposed rams via a key-slot interface.

5. The pressure control system of claim 4, wherein the bore comprises a central axis and the first pair of opposed rams is configured to move along a longitudinal axis that is orthogonal to the central axis to move between the retracted position and the extend position relative to the bore.

6. The pressure control system of claim 4, wherein the annular seal element of the RCD seal assembly is configured to be positioned below the first pair of opposed rams along a vertical axis, such that the annular seal element of the RCD seal assembly is positioned between the first pair of opposed rams and a well along the vertical axis when the pressure control system is installed at the well.

7. The pressure control system of claim 4, comprising a second pair of opposed rams positioned within the housing, wherein the second pair of opposed rams is configured to move between a respective retracted position and a respective extended position relative to the bore, and the second pair of opposed rams comprises shear rams that are configured to shear the tubular within the bore or pipe rams that are configured to seal about the tubular within the bore.

8. The pressure control system of claim 4, comprising a controller, wherein the controller is configured to drive the first pair of opposed rams from the retracted position to the extended position in response to alignment between the first pair of opposed rams and the RCD seal assembly along a vertical axis to thereby couple the first pair of opposed rams and the RCD seal assembly to one another.

9. The pressure control system of claim 8, comprising a second pair of opposed rams positioned within the housing, wherein the second pair of opposed rams is configured to move between a respective retracted position and a respective extended position relative to the bore, and the controller is configured to:

control one or more first actuators to hold the first pair of opposed rams in the retracted position;

control one or more second actuators to hold the second pair of opposed rams in the respective extended position;

control a tool to lower the RCD seal assembly into the bore until there is contact between the RCD seal assembly and the second pair of opposed rams; and control the tool to raise the RCD seal assembly by a known distance after the contact between the RCD seal assembly and the second pair of opposed rams to provide the alignment between the first pair of opposed rams and the RCD seal assembly along the vertical axis.

10. A pressure control system, comprising:

a housing comprising a bore;

a first pair of opposed rams positioned within the housing, wherein the first pair of opposed rams is configured to move between a retracted position and an extended position relative to the bore; and a rotating control device (RCD) seal assembly comprising:

a frame that is configured to couple to the first pair of opposed rams while the first pair of opposed rams are in the extended position relative to the bore;

an annular seal element coupled to the frame, wherein the annular seal element is configured to seal about a tubular within the bore; and a bearing assembly positioned between the annular seal element and the frame, wherein the bearing assembly is configured to enable the annular seal element to rotate relative to the frame and the first pair of opposed rams, wherein the first pair of opposed rams is configured to shear the tubular or to seal about the tubular while the RCD seal assembly is not coupled to the first pair of opposed rams.

11. A method of using a rotating control device (RCD) system, the method comprising:

positioning an RCD seal assembly within a bore of a housing;

driving opposed rams that are supported in the housing from a retracted position in which the opposed rams are withdrawn from the bore of the housing to an extended position in which the opposed rams are positioned within the bore of the housing in response to alignment between the opposed rams and the RCD seal assembly along a vertical axis to thereby couple the opposed rams to the RCD seal assembly;

holding the opposed rams in the retracted position as a tool lowers the RCD seal assembly into the bore of the housing;

holding additional opposed rams that are supported in the housing in a respective extended position as the tool lowers the RCD seal assembly into the bore of the housing;

lowering the RCD seal assembly until there is contact between the RCD seal assembly and the additional opposed rams; and raising the RCD seal assembly after the contact between the RCD seal assembly and the additional opposed rams by a known distance to provide the alignment between the opposed rams and the RCD seal assembly along the vertical axis.

12. The method of claim 11, further comprising:

circumferentially surrounding the RCD seal assembly with the opposed rams while the opposed rams are coupled to the RCD seal assembly, sealing against a tubular within the bore using an annular seal element of the RCD seal assembly while the opposed rams are coupled to the RCD seal assembly, and sealing against the housing using one or more seal elements supported on the opposed rams while the opposed rams are coupled to the RCD seal assembly to thereby seal the bore.

* * * * *